US009444148B2

(12) United States Patent
Shashi et al.

(10) Patent No.: US 9,444,148 B2
(45) Date of Patent: Sep. 13, 2016

(54) PRINTED QUASI-TAPERED TAPE HELICAL ARRAY ANTENNA

(75) Inventors: Bhushan Sharma Shashi, Ahmedabad (IN); Jyoti Rajeev, Ahmedabad (IN); Sanandiya Harjivan, Ahmedabad (IN); Sravan Kumar Sagi, Ahmedabad (IN); Harshadrai Trivedi Yogesh, Ahmedabad (IN); Nalinkant Pandya Bhargav, Ahmedabad (IN)

(73) Assignee: Indian Space Research Organisation of ISRO, Bangalore (IN)

( * ) Notice: Subject to any disclaimer, the term of this patent is extended or adjusted under 35 U.S.C. 154(b) by 285 days.

(21) Appl. No.: 13/388,554

(22) PCT Filed: Sep. 22, 2009

(86) PCT No.: PCT/IN2009/000517
§ 371 (c)(1),
(2), (4) Date: Apr. 16, 2012

(87) PCT Pub. No.: WO2011/016045
PCT Pub. Date: Feb. 10, 2011

(65) Prior Publication Data

US 2012/0188142 A1 Jul. 26, 2012

(30) Foreign Application Priority Data

Aug. 6, 2009 (IN) ..... 1876/CHE/2009

(51) Int. Cl.
*H01Q 1/36* (2006.01)
*H01Q 21/06* (2006.01)
(Continued)

(52) U.S. Cl.
CPC ..... *H01Q 21/067* (2013.01); *H01Q 1/523* (2013.01); *H01Q 11/083* (2013.01)

(58) Field of Classification Search
USPC ..... 343/700 MS, 702, 905, 895, 860
See application file for complete search history.

(56) References Cited

U.S. PATENT DOCUMENTS 4,169,267 A 9/1979 Wong et al.
4,170,013 A * 10/1979 Black ..... H01Q 9/0407 343/700 MS (Continued)

FOREIGN PATENT DOCUMENTS

DE 4443055 A1 6/1996
DE 19855115 A1 6/2000

(Continued)

OTHER PUBLICATIONS

German Office action dated Jul. 17, 2013 in corresponding DE App. No. 112009005121.9.

(Continued)

*Primary Examiner* — Hoang V Nguyen
*Assistant Examiner* — Hai Tran
(74) *Attorney, Agent, or Firm* — D. Peter Hochberg; Sean F. Mellino

(57) ABSTRACT

A printed quasi-tapered tape helical element and printed helical array antenna. The helical element comprises a thin helix conductor having a uniform section associated with a tapered section. The helix conductor can be printed on a thin dielectric sheet and bonded to a hollow composite dielectric support. A solid copper conductor is configured to provide electrical connection between a feeding point of the helix conductor and a microstrip line of a microstrip feed network. The uniform and tapered helix turns are respectively wrapped around the uniform and tapered sections, which enables impedance matching, axial mode excitation, gain and radiation patterns, and damping out of standing waves generated in current distribution over the helix conductor. Conductive composite cups surrounding each helical element reduces mutual coupling in array environment. Thus, the helical element and the array antenna achieve low on-axis and off-axis axial ratio performance over the wide-band for global coverage.

22 Claims, 8 Drawing Sheets

(51) Int. Cl.
*H01Q 1/52* (2006.01)
*H01Q 11/08* (2006.01)

(56) References Cited

U.S. PATENT DOCUMENTS

| | | | | |
|---|---|---|---|---|
| 4,427,984 | A | 1/1984 | Anderson | |
| 4,547,779 | A * | 10/1985 | Sanford | H01Q 9/0421 343/700 MS |
| 5,258,771 | A * | 11/1993 | Praba | H01Q 11/08 343/844 |
| 5,345,248 | A | 9/1994 | Hwang et al. | |
| 5,353,040 | A | 10/1994 | Yamada et al. | |
| 5,572,227 | A | 11/1996 | Pal et al. | |
| 5,963,170 | A * | 10/1999 | Garner | H01Q 1/242 343/702 |
| 6,337,670 | B1 * | 1/2002 | Chen | H01Q 1/24 343/700 MS |
| 6,501,437 | B1 * | 12/2002 | Gyorko | H01Q 1/362 343/700 MS |
| 6,816,126 | B2 | 11/2004 | Yasukawa et al. | |
| 7,126,557 | B2 * | 10/2006 | Warnagiris | H01Q 1/362 343/872 |
| 2002/0113736 | A1 * | 8/2002 | Toutain | H01Q 9/0407 343/700 MS |
| 2003/0164805 | A1 | 9/2003 | Strickland | |
| 2004/0257298 | A1 * | 12/2004 | Larouche | H01Q 1/362 343/895 |
| 2006/0119532 | A1 | 6/2006 | Yun et al. | |
| 2009/0243166 | A1 * | 10/2009 | Noguchi | C04B 35/195 264/631 |

FOREIGN PATENT DOCUMENTS

| | | | |
|---|---|---|---|
| DE | 10052748 | A1 | 5/2002 |
| DE | 102009034429 | A1 | 3/2011 |
| GB | 2175748 | A | 12/1986 |
| GB | 2196483 | A | 4/1988 |
| GB | 2283131 | A | 4/1995 |
| WO | WO 91/15621 | | 10/1991 |
| WO | WO 91/15621 | A1 | 10/1991 |
| WO | 02/33783 | A2 | 4/2002 |

OTHER PUBLICATIONS

German Office action dated Nov. 22, 2013 in corresponding DE App. No. 112009005121.9.

GB Office action dated Oct. 24, 2013 in corresponding GB App. No. GB1201867.7.

GB Office action dated Oct. 22, 2014 in corresponding GB App. No. GB1201867.7.

International Preliminary Report on Patentability dated Feb. 21, 2012 of corresponding PCT/IN2009/000517.

Written Opinion dated Jan. 27, 2012 of corresponding PCT/IN2009/000517.

International Search Report dated Jan. 27, 2012 of corresponding PCT/IN2009/000517.

Mallach, P; "Dielektrische Richtstrahler"; In: Fermeldetechnische Zeitschrift; (periodical) vol. 2 (1949), No. 2, pp. 33-40 (see concise explanation attached hereto).

Mueller, G.E. and Tyrrel, W.A.; "Polyrod Antennas;" Bell Syst. Tech. J. (vol. 26) (1947), pp. 837-851 (see concise explanation attached hereto).

Pehl, Erich; "Mikrowellentechnik; vol. 2 of Mikrowellenantennen, Mikrowellenrohren, Mikrowellenhalbleiter and Halbleiterschaltungen;" (second edition) Heidelberg: Huthig (1989), pp. 67-75 (ISBN 3-7785-1667-1) (see concise explanation attached hereto).

* cited by examiner

PRINTED QUASI-TAPERED TAPE HELICAL ARRAY ANTENNA

CROSS-REFERENCE TO RELATED APPLICATIONS

This application is a National Stage application of International Application No. PCT/IN2009/000517, filed on Sep. 22, 2009, which claims priority of Indian patent application number 1876/CHE/2009, filed on Aug. 6, 2009, both of which are incorporated herein by reference in their entireties.

BACKGROUND OF THE INVENTION

1. Field of the Invention

The present invention relates to the fields of antennas for space applications. The present invention specifically relates to a printed quasi-tapered tape helical element and quasi-tapered helical array antenna.

2. Description of the Prior Art

Traditionally, helix antennas are realized with electrical conductors such as solid or hollow conductors, supported by an electrically insulating material. Sometimes, a helix conductor is extended through a balun to the coaxial connector as an electrical connection. The dielectric arms extending from the metallic support at the centre are used to support the helix antennas. These helix antennas are designed to radiate in an axial mode of operation, i.e. maximum radiation along the axis of the helix antenna, where the basic design equations are well established in the literature for initial design. The end tapering reduces the reflected wave, i.e. standing wave distribution of current over helix turns from the open end of the helix antenna.

U.S. Pat. No. 4,169,267 and U.S. Pat. No. 5,345,248 describe the helical antenna that generates a radiation beam with reduced on axis axial ratio. In U.S. Pat. No. 4,169,267, two different tapers are utilized for optimizing both gain and axial ratio as shown in FIG. 1, which illustrates a helix element geometry configured with various combinations of tapered diameter and uniform sections 100 and 102. Such a helical antenna utilizes two uniform sections 100 and 102 of helix and two tapered sections 101 and 103 of the helix for different frequency bands. However, this conventional approach neither improves off axis axial ratio nor gives compact size of helix 4 wavelengths).

Moreover, U.S. Pat. No. 5,258,771 describes interleaving of the array of different frequency band elements to achieve the dual band performance of the helical array. However, this exhibits an inherent limitation of loading high frequency helix array by the low frequency helix array. Hence, the performance of high frequency helix array is compromised while comparing with low frequency helix array. In an antenna array configuration, each radiator is placed at the nodes of an array lattice to ensure effective radiation efficiency. Each radiator in the presence of an array of radiators suffers from mutual coupling, which degrades the axial ratio and the main beam symmetry. The distance between each radiator cannot be increased as it is dictated by the gain of individual element and requirement of high gain of array antenna.

U.S. Pat. No. 5,345,248 describes a scheme of reducing the mutual coupling effect by staggering the radiators in an amount equal to one turn of a helix length along the axial direction. However, this concept cannot be used in the direct radiating feed array configuration. Further, the feeding mechanism also becomes most critical which controls both impedance matching and insertion loss. Thus, it is more desirable to have direct mounting of helix to the feeding transmission line. U.S. Pat. No. 6,816,126 B2 describes a scheme of feeding the tape helical element and circular helical array with parallel plate feeding mechanism, but such feeding mechanism cannot be extended to other transmission line. Also, the conventional helix antenna impedance matching is accomplished by using additional conducting strip loading at helix feeding point or balun circuit.

In general, the circular polarization purity in terms of off-axis axial ratio performance over the wideband is essential for wide beam space borne antennas, i.e. navigation, mobile and communication satellite antennas. Nominally, the off-axis axial ratio less than 3 dB is the acceptable performance but the advanced satellite technology requires axial ratio less than 2 dB over the global coverage. With respect to the conventional approaches, the uniform helix antenna with conventional support for the helix conductor achieves inherent high axial ratio (on-axis and off-axis) performance. This is mainly due to the current distribution over the helix conductor, which generates standing wave patterns. The low axial ratio (on-axis and off-axis) performance over the wide band is difficult to achieve as compared to the return loss performance when helix axial length is less than one wavelength. In such a conventional helix antenna, the on-axis axial ratio performance improves up to the certain value with an increase in the number of turns while the off-axis axial ratio remains high. Therefore, it is desirable to provide a printed quasi-tapered tape helical array antenna, which achieves low axial ratio (on-axis and off-axis) performance over the wideband for global coverage.

SUMMARY OF THE PRESENT INVENTION

Object of the Invention

An object of the present invention is to provide a printed quasi-tapered tape helical element, which achieves low on-axis and off-axis axial ratio performance over the wideband for global coverage.

Another object of the present invention is to provide a printed quasi-tapered tape helical element, which facilitates optimum RF performance with a minimal number of turns.

Yet another object of the present invention is to provide a printed quasi-tapered tape helical array antenna, which provides wide band radiation performance with extremely low electromagnetic mutual coupling between the elements.

Yet another object of the present invention is to provide a printed quasi-tapered tape helical array antenna, which ensures suppression of surface currents induced on neighboring elements.

Yet another object of the present invention is to provide a printed quasi-tapered tape helical array antenna, which is lightweight and compact in size.

According to one aspect, the present invention, which achieves the objectives, relates to a printed quasi-tapered tape helical element comprising a thin helix conductor having a uniform section associated with a tapered section. The helix conductor is printed on a thin dielectric sheet and is bonded to a hollow composite dielectric support. A solid copper conductor is configured to provide an electrical connection between a feeding point of the helix conductor and a microstrip line of a microstrip feed network. The uniform and tapered helix turns are respectively wrapped around the uniform and tapered sections, which enables impedance matching, axial mode excitation, gain and radiation patterns, and damping out of standing waves generated in current distribution over the helix conductor. Thus, the helical element achieves low on-axis and off-axis axial ratio performance over the wideband for global coverage.

According to one aspect, the present invention, which achieves the objectives, relates to a printed quasi-tapered tape helical array antenna comprising multiple quasi-tapered tape helical elements arranged in an array with inter-element spacing. A set of quarter wave section transformers is disposed within a corporate feed network for power division and transformation of impedance of the helical elements to input impedance. Multiple conductive cups are configured to surround the helical elements in a conductive composite ground plane. The conductive cups prevent electromagnetic mutual coupling between the helical elements, which achieves wide band radiation performance and ensures suppression of surface currents induced on the neighboring elements.

Furthermore, the helical antenna provides radiation characteristic over wideband, which covers L1-Band (1565.42-1585.42 MHz), L2-Band (1240-1260 MHz) and L5-Band (1166.45-1186.45 MHz). The helical element are bonded to composite dielectric tube and integrated to form array antenna, where the single helix element provides optimum RF performance with minimal number of turns. The axially compact array antenna is configured to achieve more than 35% bandwidth performance for low axial ratio over 3 dB beamwidth.

Moreover, each helical element is fed with uniform amplitude and phase by directly mounting and combining the feed network with array. The launching of axial mode in each helix element reduces the transition hardware. The impedance of the helix element can be transformed directly to 50 ohms within the feed network, which constitutes a multi-layered composite structure. The metallic cups for each helix element decouple the surface currents by minimizing the mutual coupling between the helix elements in array.

BRIEF DESCRIPTION OF THE DRAWINGS

The invention will be discussed in greater detail with reference to the accompanying Figures.

DETAILED DESCRIPTION OF THE INVENTION

Figure 1:
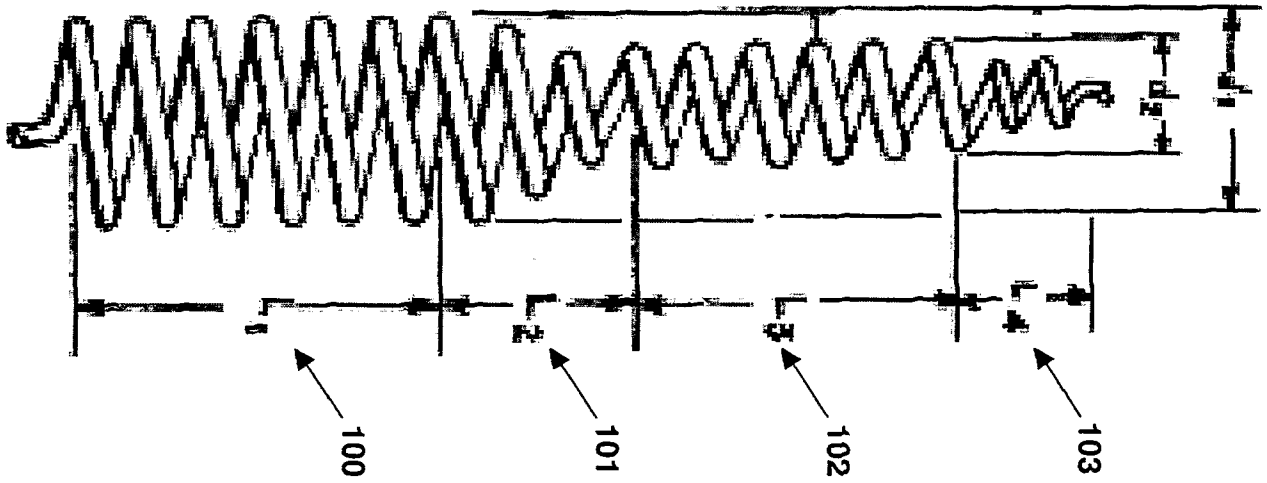
FIG. 1 (Prior Art)
FIG. 1 shows a helix element geometry configured with various combinations of tapered diameter and uniform sections, in accordance with a prior art.
Figure 2:
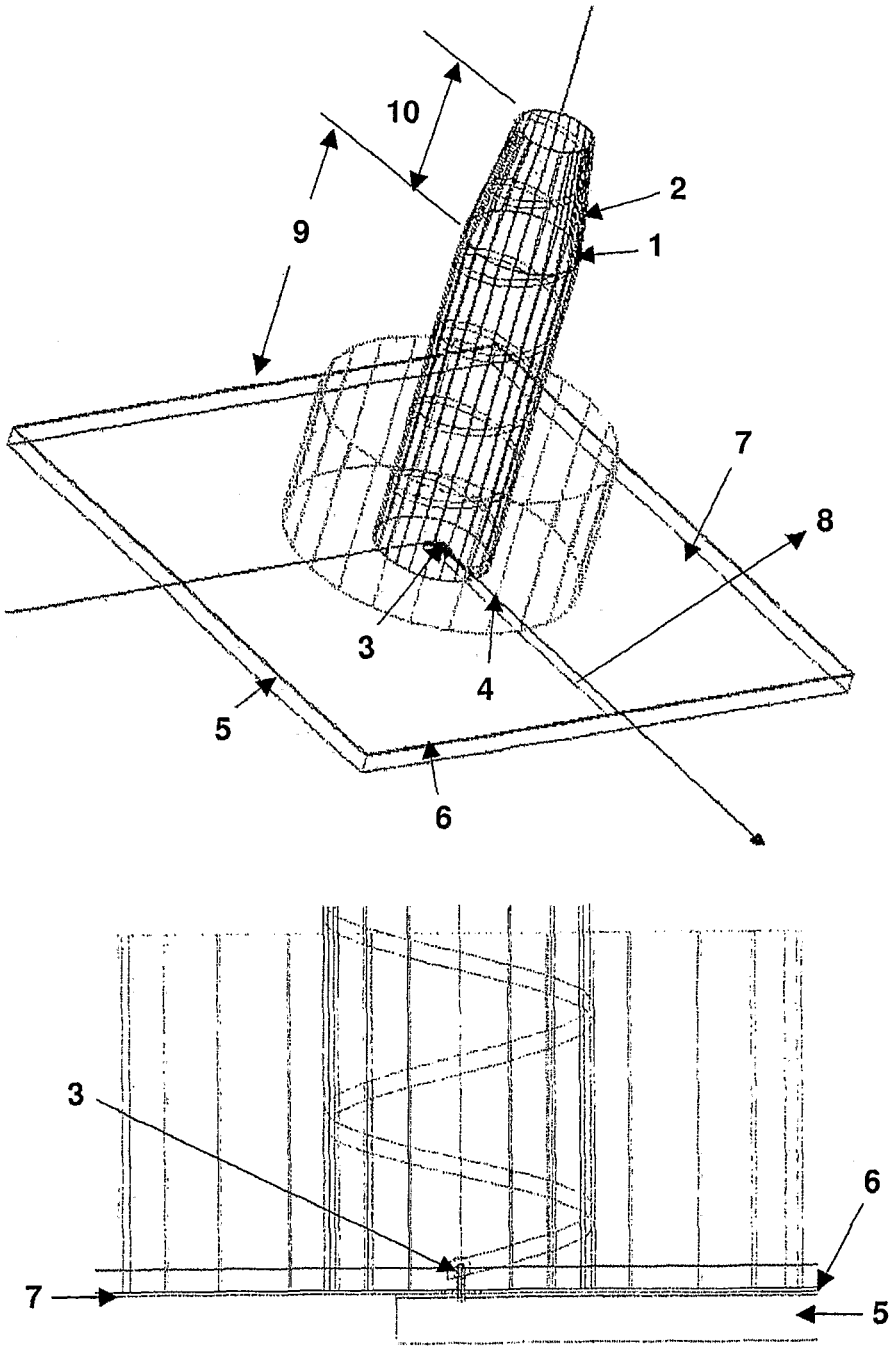
FIG. 2 illustrates a 3D-view of a printed quasi-tapered tape helical element, in accordance with an exemplary embodiment of the present invention.

Referring to FIG. 2, a 3D-view of a printed quasi-tapered tape helical element is illustrated, in accordance with an exemplary embodiment of the present invention. The printed quasi-tapered tape helical element comprises a flat ultra thin helix conductor 1 that is printed on a thin dielectric sheet. The printed helix conductor 1 is bonded to a hollow composite dielectric support 2. Since the flat ultra thin printed helix conductor 1 is lightweight as compared to the copper wire or a conducting hollow tube as a helix conductor, thus a quasi-tapered printed helical antenna is compact in geometry with very low on-axis and off-axis axial ratio along with required gain. Such quasi-tapered helix element exhibits shorter length than the uniform helix element for the specified RF performance.

In addition, a solid copper conductor 3 connects the tape helical conductor 1 to a microstrip line of a microstrip feed network circuit 8, where the copper conductor 3 also functions as an impedance matching element. The quasi-tapered helix element comprises a uniform helix conductor section 9 followed by a tapered helix conductor section 10. In the uniform section 9 of the helix element, the first few helix turns play a significant role for the impedance matching and axial mode excitation, which can be referred to as a launching section. Remaining uniform helix turns of the uniform section 9 work as a director and play a vital role for the overall helix antenna RF performance, especially for the gain and radiation patterns. The last few tapered turns in the tapered section 10 work as a helix terminator, which damps out the standing waves generated in current distribution over the helix conductor 1. This standing wave free current distribution improves on-axis & off-axis axial ratio performance of the quasi-tapered helix antenna.

Further, the quasi-tapered helix conductor 1 allows traveling waves in the forward direction only. The electromagnetic radiation starts at the end of helix conductor 1. In order to achieve the wideband performance, the helix antenna should operate in the end fire, traveling wave condition. In addition, the helix conductor spring diameter can be reduced by utilizing dielectric material as the tube support 2 for the helix conductor 1, where this reduction in spring diameter mainly depends on the dielectric constant of dielectric material and its thickness. The high dielectric constant of the helix support material improves the axial ratio performance compared to the air core support.

The compact quasi-tapered helix antenna exhibits less than six uniform turns, which is terminated by the tapered section 10 of less than three turns. The pitch distance is constant throughout the helix conductor structure 1. The printed helix conductor 1 can be bonded over the outer surface of the dielectric composite support 2 using an adhesive. The composite helix dielectric support 2 can be fastened or bonded on the top face of a thin composite ground plane 7, which is conductive in nature. Copper clad groundside of a feed network PCB 6 can be bonded to the second face of the thin composite ground plane 7. A dielectric composite honeycomb 5 can be bonded with very thin dielectric composite face skins on both its faces. This dielectric composite honeycomb 5 is sandwiched between the feed network PCB 6 and the carbon composite antenna support 2.

Moreover, a metallic cup 4 surrounds the helix element in the thin composite ground plane 7 to reduce the effect of mutual coupling, where the metallic cup is a conductive cylindrical cup. Such quasi-tapered helical radiator with the cylindrical metallic cup 4 provides wide band radiation performance with extremely low electromagnetic mutual coupling between the elements in array environment. This design ensures suppression of surface currents induced on neighboring elements and improves radiation performance i.e. directivity and axial ratio over global coverage.

A microwave substrate with a low CTE (Coefficient of Thermal Expansion) and low out-gassing is used in the realization of microstrip feed network PCB 6. Then, the solid copper conductor 3 provides an electrical connection between the helix element feeding point and the feed network 6. A high temperature solder joint is connected to the solid conductor 3 at both ends. Thus, the overall length of the quasi-tapered printed helix element is less than one wavelength at the lowest operating frequency, which results in an ultra lightweight helix. The quasi-tapered tape helix element can be electromagnetically fed by the multilayer corporate microstrip (1:16) feed network 8 of wide band equal phase and equal amplitude, where the microstrip feed network 8 is developed on the dielectric substrate. Thus, the additional losses due to any connector of the helix antenna are reduced.

Figure 3:
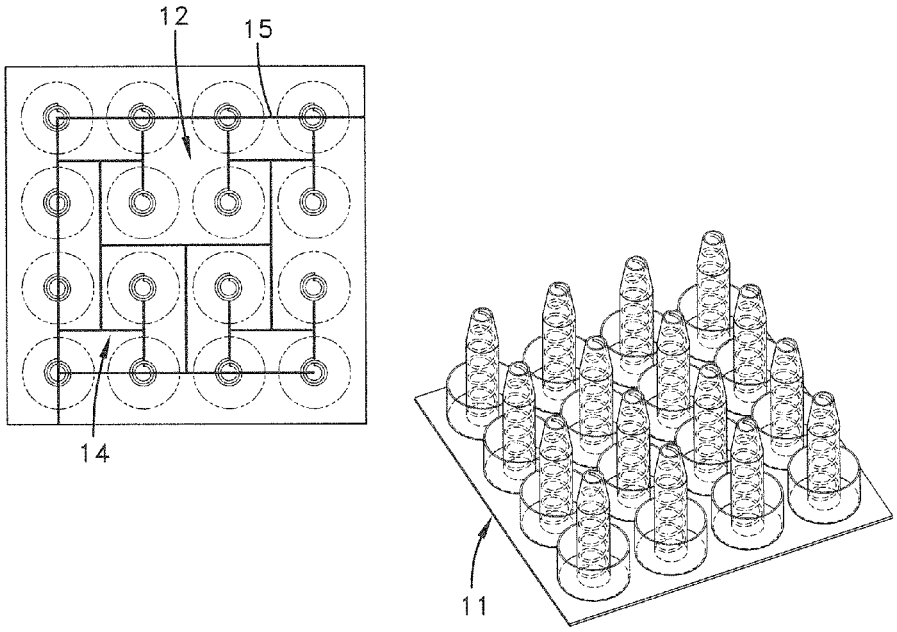
FIG. 3 illustrates different geometrical views of 4×4 printed quasi-tapered tape helical array antennas with a feed network circuit, in accordance with an exemplary embodiment of the present invention.
Figure 3:
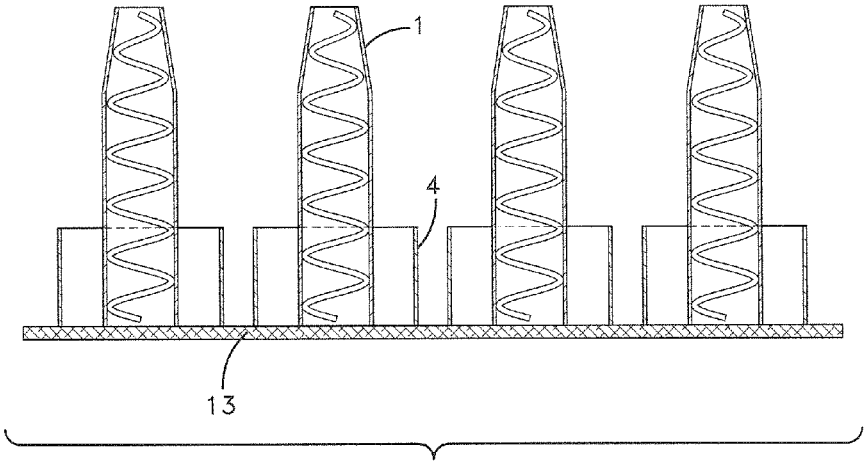

Referring to FIG. 3, different geometrical views of 4×4 printed quasi-tapered tape helical array antennas with a feed network circuit are illustrated, in accordance with an exemplary embodiment of the present invention. The 4×4 printed helical array antenna comprises a multi-layer structure with multiple helix elements that are arranged in inter-element spacing. Then, the optimum inter-element spacing of the helix elements can be derived for maximum gain and axial ratio performance. The inter-element spacing is one wavelength at highest operating frequency in the printed helical antenna.

The wideband 4×4 printed helical array antenna utilizes two-quarter wave section transformers 14 within a feed network 15 for power division and transforming the helix impedance to input impedance. The feed network 15 is arranged on a feed network PCB 12 in connection with a composite ground plane 11, where a dielectric composite honeycomb structure 13 can be secured to the composite ground plane 11. The feed network 15 is a corporate type microstrip circuit designed for equal phase and amplitude distribution with minimum insertion loss. Such low insertion loss ensures minimum power dissipation within the feed network 15 to restrict delta rise in temperature for 100 watts average input RF power.

Additionally, the single wideband microstrip feed network 15 can be designed for the L1, L2 and L5 band frequencies, i.e. 1166.45-1585.42 MHz (418.97 MHz operating band). The realization of large size (0.8 m×0.8 m) wideband (>35%) microstrip feed network 15 using the microwave substrate is capable of handling 80-Watts average RF power in GEO orbital environment. The feed network 15 can be utilized as amplitude and phase distribution for each helix element in the array and as impedance matching of each helix element.

This helix antenna achieves impedance matching without any means like a balun circuit or a conducting strip loading at the helix feed point. Such unique wideband impedance matching enables to transform the helix element impedance to 50 ohms input impedance within the feed network 15.

Figure 4:
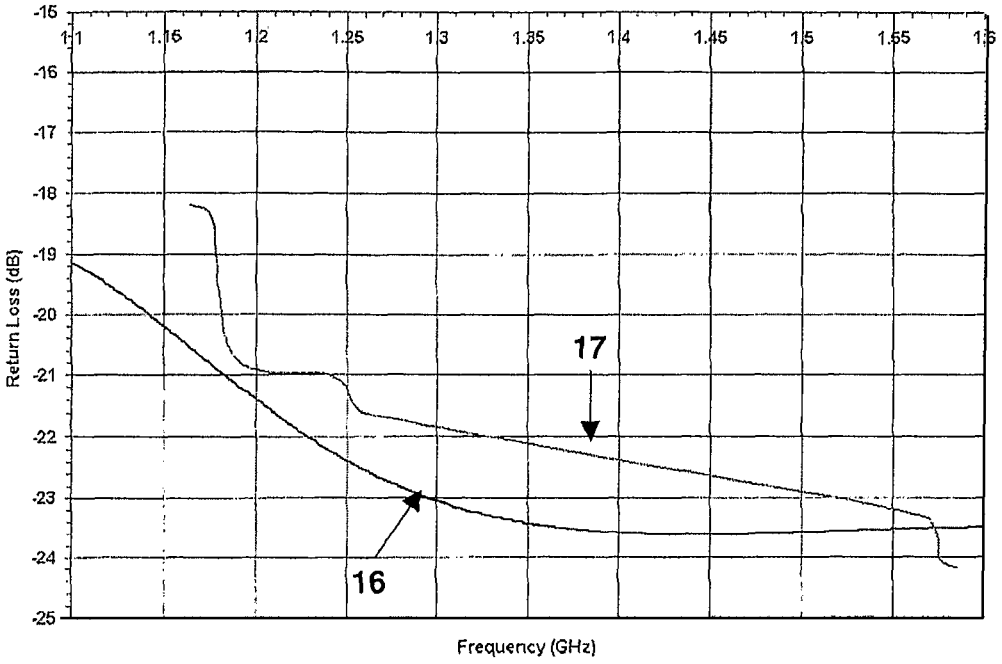
FIG. 4 illustrates a graph of return loss performance of the single printed helix element and the 4×4 printed helical array antenna, in accordance with an exemplary embodiment of the present invention.
Figure 5:
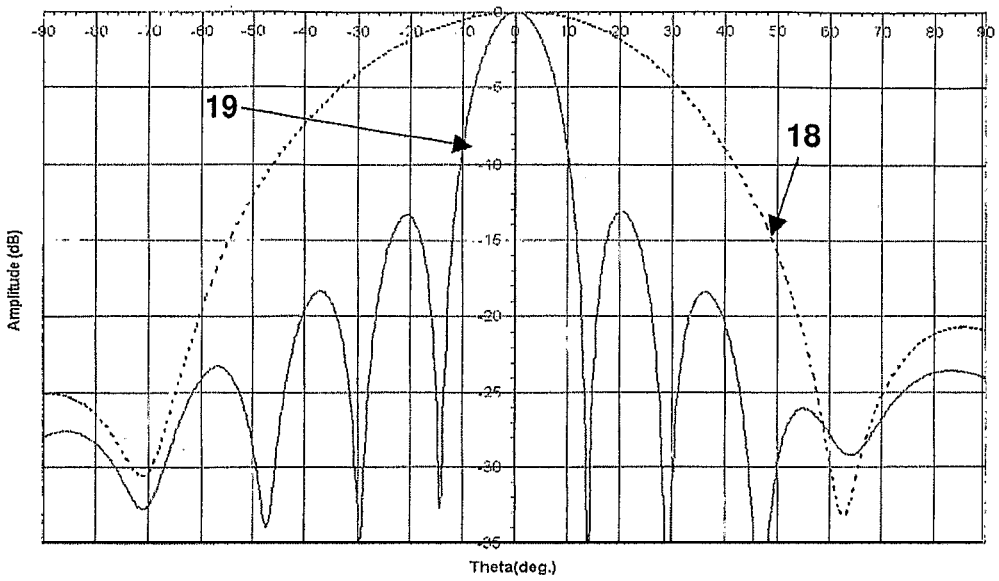
FIG. 5 illustrates a graph of radiation patterns performance of the single printed helix element and the 4×4 printed helical array antenna, in accordance with an exemplary embodiment of the present invention.

Referring to FIG. 4, a graph of return loss performance of the single printed helix element and the 4×4 printed helical array antenna is illustrated, in accordance with an exemplary embodiment of the present invention. In return loss performance, the measured return loss 16 of the single printed helix element and the measured return loss 17 of the 4×4 printed helical array antenna are better then −17 dB over the L1, L2 and L5 band frequencies. Similarly, the measured radiation patterns 18 and 19 of the single printed helix element and the 4×4 printed helical array antenna are shown in FIG. 5, which illustrates a graph of radiation patterns performance of the single printed helix element and the 4×4 printed helical array antenna, in accordance with an exemplary embodiment of the present invention.

Figure 6:
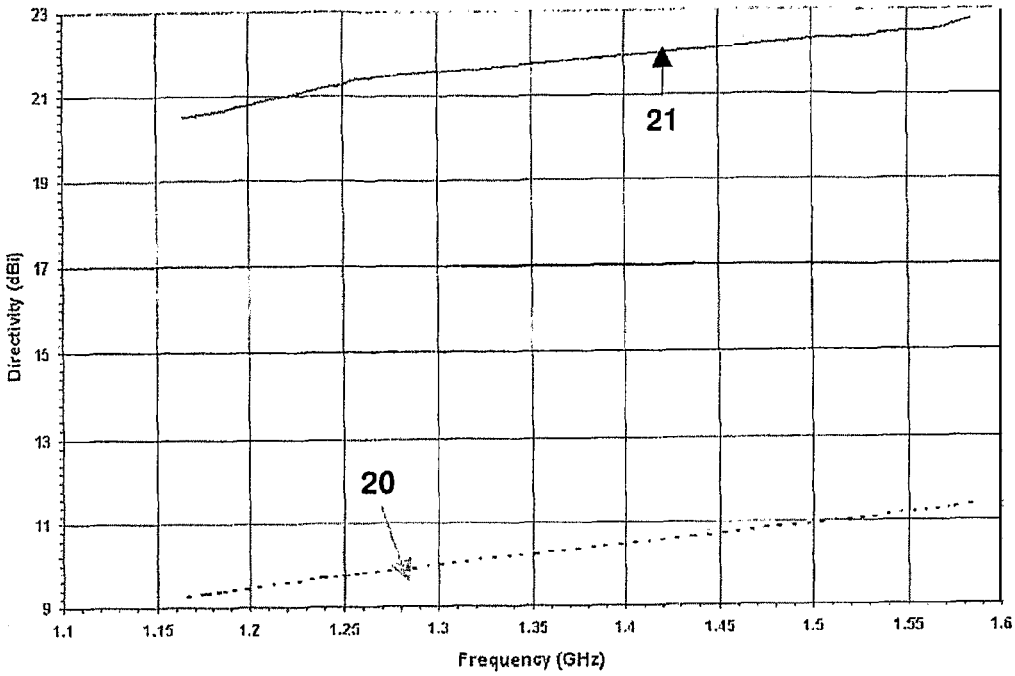
FIG. 6 illustrates a graph of directivity performance versus operating frequency of the single printed helix element and the 4×4 printed helical array antenna, in accordance with an exemplary embodiment of the present invention.

Referring to FIG. 6, a graph of directivity performance versus operating frequency of the single printed helix element and the 4×4 printed helical array antenna is illustrated, in accordance with an exemplary embodiment of the present invention. The helix antenna gain depends on the helix axial length (i.e. number of turns) and helix geometry. Thus, the analyzed directivity performance 20 and 21 of the single helix element and the 4×4 helical array antenna are better over various band frequencies.

Figure 7:
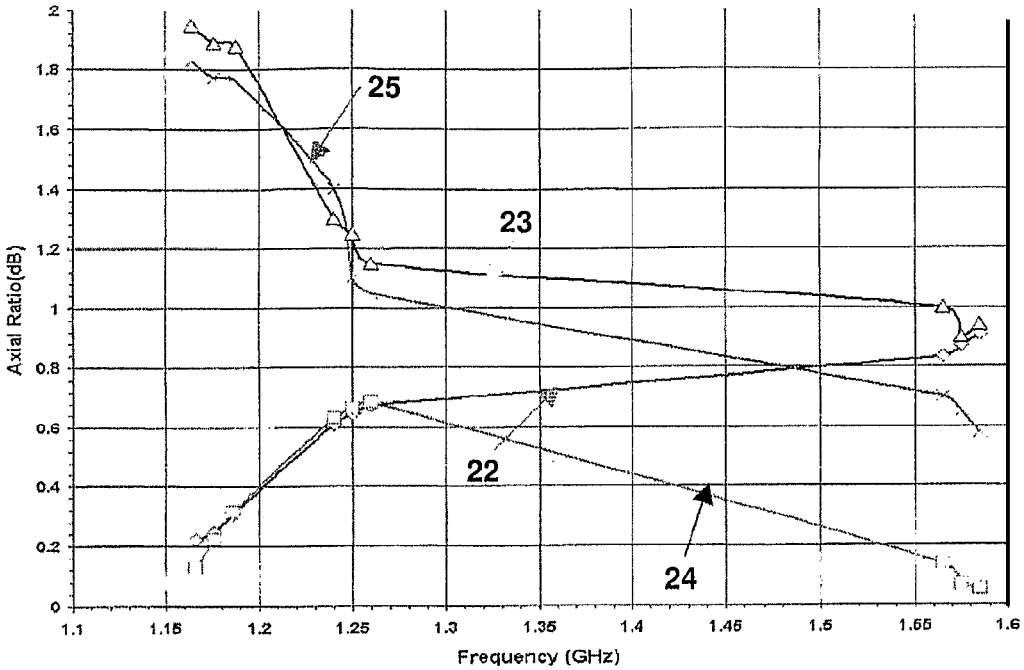
FIG. 7 illustrates a graph of axial ratio performance versus operating frequency of the single printed helix element and the 4×4 printed helical array antenna, in accordance with an exemplary embodiment of the present invention.

Similarly, the helix antenna axial ratio performance highly depends on the current distribution on the helix conductor as per helix element geometry. The printed quasi-tapered helix antenna exhibits low axial ratio (on-axis and off-axis) performance 22, 23, 24 and 25 for on-axis and off-axis condition over the wideband for wide coverage, as shown in FIG. 7, which illustrates a graph of axial ratio performance versus operating frequency of the single printed helix element and the 4×4 printed helical array antenna, in accordance with an exemplary embodiment of the present invention.

Figure 8:
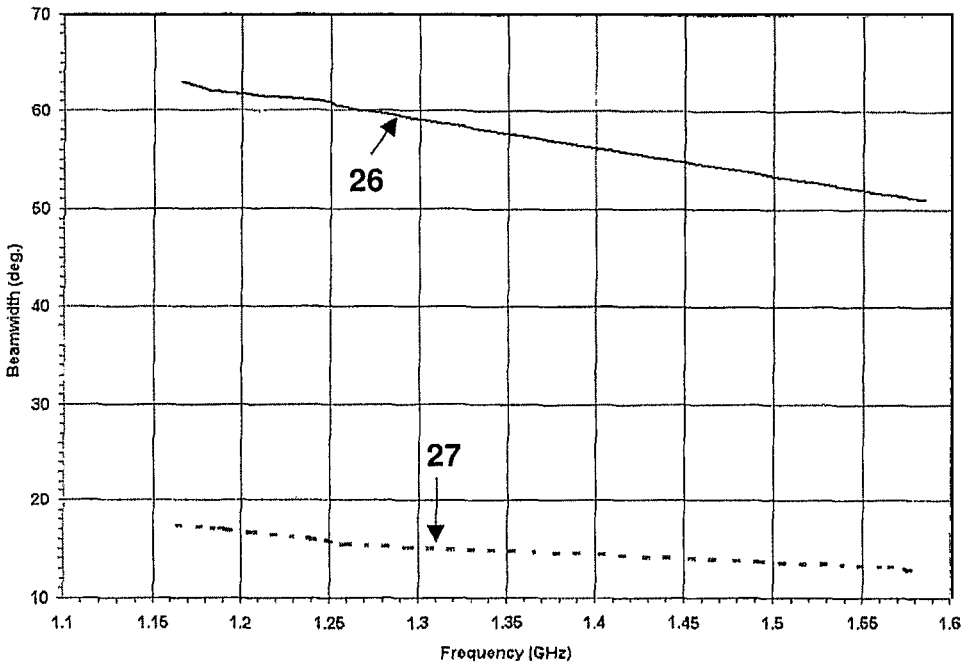
FIG. 8 illustrates a graph of 3 dB Beam-width performance versus operating frequency of the single printed helix element and the 4×4 printed helical array antenna, in accordance with an exemplary embodiment of the present invention.

FIG. 8 illustrates a graph of 3 dB Beam-width performance versus operating frequency of the single printed helix element and the 4×4 printed helical array antenna, in accordance with an exemplary embodiment of the present invention. The 3-dB beamwidth performance 26 and 27 for the single helix element and the 4×4 helical array antenna are better over the L1, L2 and L5 band frequencies. The helix antenna RF parameters such as axial ratio, gain, radiation patterns and return loss, are met through an optimum quasi-tapered helix antenna design.

Such quasi-tapered helix antenna finds applications in communication and navigation satellites either as a radiator or as an element of an array antenna. The helix antenna can also be utilized as a feed for reflector antennas and short backfire antennas. This design of helix antenna achieves wideband performance of the helical element and the helical array antenna for any space borne applications. Further, the helix antenna can be used as an exciter within the horn antenna for global coverage with circular polarization, especially for beacon applications in communication satellites.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

We claim:

1. A compact quasi-tapered tape helical element, comprising:

a thin helix conductor having a uniform helix conductor section associated with a tapered helix conductor section, wherein said helix conductor is printed on a thin dielectric sheet and bonded to a hollow composite dielectric support; and a copper conductor for providing an electrical connection between a feeding point of said helix conductor and a microstrip line of a microstrip feed network, wherein uniform and tapered helix turns are respectively wrapped around said uniform and tapered sections for enabling impedance matching, axial mode excitation, gain and radiation patterns, and damping out of standing waves generated in current distribution over said helix conductor, wherein said helical element comprises a low on-axis and off-axis axial ratio performance over the wideband more than 35% bandwidth over 3 dB beamwidth for global coverage, wherein said compact quasi-tapered tape helical element comprises less than six uniform turns terminated by said tapered section comprising less than three turns, and wherein said quasi-tapered tape helical element comprises a constant pitch throughout said helix conductor, and wherein said low axial ratio performance comprises an improved off-axis axial ratio relative to a helix element with no end tapering.

2. The helical element according to claim 1, further comprising:

a conductive composite ground plane, wherein said dielectric support is fastened and bonded to said conductive composite ground plane;

a feed network printed circuit board (PCB) in connection with said microstrip feed network and said conductive composite ground plane, said feed network printed circuit board (PCB) having a copper clad groundside; and a dielectric composite honeycomb secured to said conductive composite ground plane, wherein said dielectric composite honeycomb is sandwiched between said feed network PCB and said dielectric support.

3. The helical element according to claim 2, wherein the copper clad groundside of said feed network PCB is bonded to said conductive composite ground plane.

4. The helical element according to claim 1, wherein an adhesive bonds said helix conductor over the outer surface of said hollow composite dielectric support.

5. The helical element according to claim 1, wherein said tapered helix turns terminate said uniform helix turns.

6. The helical element according to claim 1, wherein said copper conductor is an impedance matching element.

7. The helical element according to claim 1, wherein the overall length of said helical element is less than one wavelength at lowest operating frequency.

8. The helical element according to claim 1, wherein said microstrip feed network is placed on a microwave substrate with a low coefficient of thermal expansion.

9. The helical element according to claim 1, wherein said microstrip feed network electromagnetically couples said helical element for amplitude and phase distribution and impedance matching of said helical element.

10. The helical element according to claim 1, wherein said on-axis and off-axis axial ratio performance is less than 3 dB.

11. The helical element according to claim 10, wherein said on-axis and off-axis axial ratio performance is less than 2 dB.

12. The helical element according to claim 1, wherein the last few tapered turns in said tapered helix conductor section are a helix terminator for dampening out the standing waves generated in current distribution over said helix conductor to form a standing wave free current distribution for improving on-axis and off-axis axial ratio performance of said helical element over the wideband for global coverage.

13. A compact quasi-tapered tape helical array antenna, comprising:

one or more quasi-tapered tape helical elements, arranged in array with inter-element spacing and each having a feed point, wherein each helical element comprises a thin helix conductor having a uniform helix conductor section associated with a tapered helix conductor section, wherein said helix conductor is printed on a thin dielectric sheet and bonded to a hollow composite dielectric support, and a copper conductor for providing an electrical connection between the feed point of said helix conductor and a microstrip line of a microstrip feed network, wherein uniform and tapered helix turns are respectively wrapped around said uniform and tapered sections for enabling impedance matching, axial mode excitation, gain and radiation patterns, and damping out of standing waves generated in current distribution over said helix conductor;

a plurality of quarter wave section transformers disposed within a corporate feed network configured for power division and transformation of impedance of said one or more helical elements to input impedance at said feed point of said one or more helical elements; and a plurality of conductive cups surrounding said one or more helical elements in a conductive composite ground plane, wherein said conductive cups provide reduced electromagnetic mutual coupling between said one or more helical elements, wherein said compact quasi-tapered tape helical array antenna comprises less than six uniform turns terminated by said tapered section comprising less than three turns, and wherein said quasi-tapered tape helical element comprises a constant pitch throughout said helix conductor, and wherein said compact quasi-tapered tape helical array antenna achieves more than 35% bandwidth performance for low axial ratio over 3 dB beamwidth.

14. The antenna according to claim 13, wherein the impedance of said one or more helical elements is configured to transform to 50 ohms input impedance within said corporate feed network.

15. The antenna according to claim 13, further comprising:

a conductive composite ground plane, wherein said one or more helical elements are fastened and bonded to said conductive composite ground plane;

a feed network printed circuit board (PCB) in connection with said corporate feed network and said conductive composite ground plane, said feed network printed circuit board (PCB) having a copper clad groundside; and a dielectric composite honeycomb secured to said conductive composite ground plane, wherein said dielectric composite honeycomb is sandwiched between said feed network PCB and said one or more helical elements.

16. The antenna according to claim 15, wherein the copper clad groundside of said feed network PCB is bonded to said conductive composite ground plane.

17. The antenna according to claim 13, wherein the overall length of said one or more helical elements is less than one wavelength at lowest operating frequency.

18. The antenna according to claim 13, wherein said corporate feed network is placed on a microwave substrate with a low coefficient of thermal expansion.

19. The antenna according to claim 13, wherein said one or more helical elements are electromagnetically coupled to said corporate feed network for amplitude and phase distribution and impedance matching of said helical element.

20. The compact quasi-tapered tape helical array antenna according to claim 13, wherein said compact array antenna achieves more than 35% bandwidth performance for low axial ratio over 3 dB beamwidth.

21. The compact quasi-tapered tape helical array antenna according to claim 13, wherein said compact array antenna achieves a voltage standing wave ratio (VSWR) of less than 1.4 over single element and array.

22. The compact quasi-tapered tape helical array antenna according to claim 13, wherein said compact array antenna comprises a power handling capacity of greater than 80 watts in a GEO orbital environment.

* * * * *